US005324713A

United States Patent [19]

Shen

[11] Patent Number: 5,324,713

[45] Date of Patent: Jun. 28, 1994

[54] HIGH TEMPERATURE SUPERCONDUCTOR SUPPORT STRUCTURES FOR DIELECTRIC RESONATOR

[75] Inventor: Zhi-Yuan Shen, Wilmington, Del.

[73] Assignee: E. I. Du Pont de Nemours and Company, Wilmington, Del.

[21] Appl. No.: 788,063

[22] Filed: Nov. 5, 1991

[51] Int. Cl.[5] ..... H01P 7/10; H01P 1/201; H01B 12/06

[52] U.S. Cl. ..... 505/210; 505/700; 505/701; 505/866; 333/99 S; 333/219.1; 333/202

[58] Field of Search ..... 333/995, 219.1, 202, 333/202 DR, 204; 505/1, 700, 701, 866

[56] References Cited

U.S. PATENT DOCUMENTS

| | | | |
|---|---|---|---|
| 4,319,208 | 3/1982 | de Bayser et al. | 333/204 |
| 4,963,841 | 10/1990 | Sparagna | 333/202 |
| 5,034,711 | 7/1991 | Hendrick et al. | 333/219.1 |
| 5,179,074 | 1/1993 | Fiedziuszko et al. | 333/202 X |

FOREIGN PATENT DOCUMENTS

| | | | |
|---|---|---|---|
| 0296009 | 12/1988 | European Pat. Off. | H01P 7/10 |
| 0438807 | 7/1991 | European Pat. Off. | H01P 7/10 |
| 0496512 | 7/1992 | European Pat. Off. | H01P 7/10 |
| 250201 | 10/1988 | Japan | 333/219.1 |
| 266902 | 11/1988 | Japan | 333/219.1 |
| 284902 | 11/1988 | Japan | 333/219.1 |
| 299601 | 12/1988 | Japan | 333/202 |
| 44104 | 2/1989 | Japan | 333/227 |
| 120902 | 5/1989 | Japan | 505/1 |

OTHER PUBLICATIONS

J. A. Curtis, et al., IEEE MTT-S Int'l Micorwave Syposium-Digest, vol. 2; Jun. 10-14, 1991, pp. 447-450.

C. Pao, et al., IEEE MTT-S Int'l Micorwave Syposium-Digest, vol. 1; May 25-27, 1988 pp. 457-458.

Y. Kogami et al., IEEE MTT-S Int'l Micorwave Syposium-Digest vol. 3; Jun. 10-14, 1991 pp. 1345-1348.

S. T. H. St. Martin et al., Electronics Letters, vol. 26, No. 24, Nov. 22, 1990, Stevenage GB, pp. 2015-2016.

S. J. Fiedziuszko et al., IEEE MTT-S Int'l Microwave Syposium-Digest, vol. 1; Jun. 13-15, 1989 pp. 555-558.

Patent Abstract of Japan, vol. 10, No. 175 (E-413) (2231) Jun. 20, 1986.

Braginskii et al., *IEEE Trans. Magn.*, 17(1):955 (1981).

Blair et al., *J. Phys. D. Appl. Phys.*, 15:1651 (1982).

*Primary Examiner*—Benny T. Lee

[57] ABSTRACT

The invention is directed to a superconducting microwave resonator, to holding devices for those resonators, and to their methods of manufacture. The superconducting microwave resonator employs at least two superconducting films on substrates positioned on a dielectric. The holding devices include a variety of configurations, such as, a spring loaded device. The superconducting microwave resonators have Q values of as high as microwave resonators formed of Nb, but operate at much higher temperature.

23 Claims, 11 Drawing Sheets

SAPPHIRE SIZE

- ▫ .625" DIA. BY .276" HGT
- ○ .625" DIA. BY .552" HGT
- ◇ 1" DIA. BY .472" HGT

HIGH TEMPERATURE SUPERCONDUCTOR SUPPORT STRUCTURES FOR DIELECTRIC RESONATOR

FIELD OF THE INVENTION

This invention relates to microwave resonators formed of high temperature superconductor and dielectric materials as well as to electronic circuits that employ those microwave resonators.

BACKGROUND OF THE INVENTION

Microwave resonators are known for use in time and frequency standards, frequency stable elements, as well as building blocks for passive devices such as filters and the like. The performance of the microwave resonator is gauged by its Q-value, expressed as $$Q=2\pi f_0 * (\text{Storage energy/Loss power}), \quad (1)$$

where $f_0$ is the resonant frequency of the microwave resonator. (See Hayt, J. R., "Engineering Electromagnetics", 1981, p. 472). As shown in Equation (1), the Q-value of the microwave resonator can be increased by reducing the loss power associated with factors such as conductor loss, dielectric loss, and radiation loss.

Low temperature ($T_c$), such as 4K, superconducting microwave resonators which employ a superconducting cavity made of Nb are known to have Q-values from about $10^6$ to $10^9$. (See V. B. Bragrinskii, et al: "The Properties of Superconducting Resonators on Sapphire", IEEE Trans. on Magn. Vol. 17, No. 1, P955, 1981, as a reference.) Although low $T_c$ Nb microwave resonators have high Q-values, they must operate at very low temperatures (below 9K). These microwave resonators require use of curved cavity walls. Curved cavity walls of materials which have a high $T_c$, of for example 77K, however, are difficult to produce. On the other hand, high Q-value microwave resonators formed merely from a dielectric without an associated conducting medium also have high Q-values (see D. G. Blair, et al: "High Q Microwave Properties of a Sapphire Ring Resonator", J. Phys. D: Appl. Phys., 15, P1651, 1982.) However, the problems associated with the far reaching evanescent fields make them very bulky and vulnerable to microphonic effect, which limits the applications.

The need therefore exists for microwave resonator made of high $T_c$, such as 77K, superconductor that have Q-values comparable to low $T_c$ superconducting microwave resonators made of Nb.

BRIEF DESCRIPTION OF THE DRAWINGS

FIG. 7(*b*) shows the vertical cross sectional view of the same alternative embodiment shown in FIG. 7(*a*).

SUMMARY OF THE INVENTION

The invention is directed to high temperature superconductor-dielectric microwave resonators, to holding devices for those resonators, coupling of those resonators to electronic circuits, and to their methods of manufacture. The superconducting microwave resonator of the invention employ a superconducting film on substrates positioned on a dielectric. The holding devices include a variety of configurations, such as, a spring loaded device. The microwave resonators can be readily coupled to electronic circuits. The superconducting microwave resonators have Q values that are as high as low temperature microwave resonators formed of Nb, but operate at much higher temperature.

In accordance with the invention, a high temperature superconducting microwave resonator comprising a dielectric and a plurality of substrates bearing a coating of high temperature superconducting material is provided. The substrates are positioned relative to the dielectric to enable the coating to contact said dielectric.

The invention also includes devices for retaining the configuration of the superconducting microwave resonator of the invention. These devices comprise means to retain the relative positions of the substrate and the dielectric during use of the microwave resonator in an electrical circuit. These devices further comprise means for coupling of the microwave resonator to electrical circuits.

The invention is further directed to a method for coupling the superconducting microwave resonator of the invention to an electric circuit by employing means positioned on the substrate for transferring electromagnetic energy between the dielectric of the superconducting microwave resonator and an electrical circuit via openings on the superconducting films and coupling lines.

The invention is still further directed to passive devices such as filters that are formed of a plurality of dielectrics positioned between a plurality of substrates bearing a coating of high temperature superconducting material, or wherein the dielectrics and substrates are in alternating positions relative to each other.

DETAILED DESCRIPTION OF THE INVENTION

Having briefly summarized the invention, the invention will now be described in detail by reference to the following specification and non-limiting examples. Unless otherwise specified, all percentages are by weight and all temperatures are in degrees Kelvin.

Figure 1A:
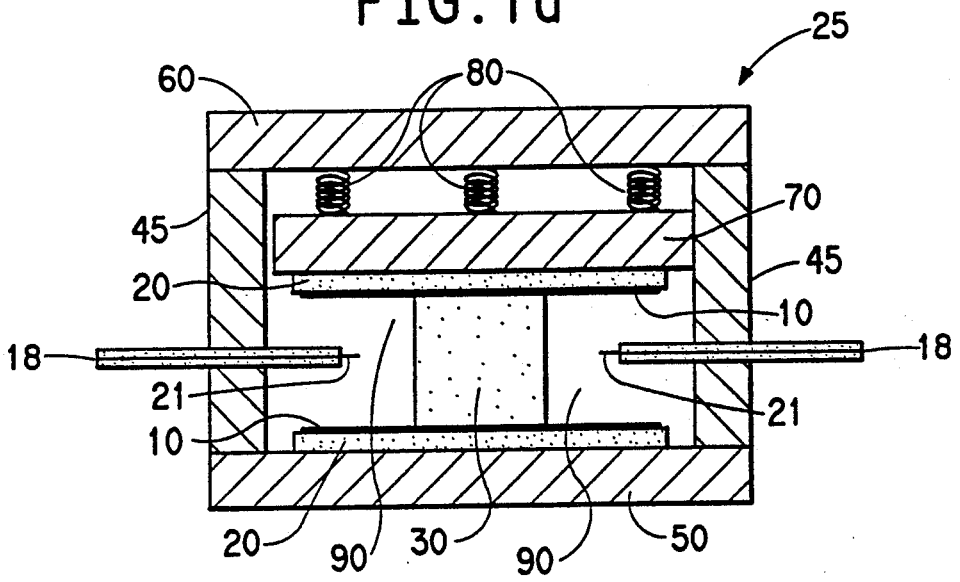
FIGS. 1(*a*) and 1(*b*) show a vertical cross section of superconducting microwave resonator and a holding device for that resonator.
Figure 1B:
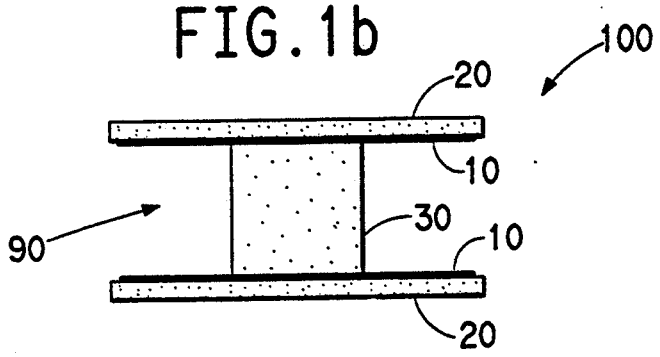

FIG. 1 shows superconducting microwave resonator and a holding device for that resonator. As shown in FIGS. 1(*a*) and 1(*4*), a superconducting microwave resonator 100 with cavity 90 is provided in the form of substrates 20 bearing superconducting film 10 positioned on dielectric 30. Substrate 20 is a single crystal that has a lattice matched to superconductor film 10. Preferably, substrates 20 are formed of $LaAlO_3$, $NdGaO_3$, MgO and the like.

Generally, superconductor film 10 may be formed from any high $T_c$ superconducting material that has a surface resistance ($R_s$) that is at least ten times less than that of copper at any specific operating temperature. $T_c$ can be determined by the "eddy current method" using a LakeShore Superconductor Screening System, Model No. 7500. Surface resistance of superconducting film 10 can be measured by the method described in Wilker et al., "5-GHz High-Temperature-Superconductor Resonators with High Q and Low Power Dependence up to 90K" IEEE, Trans. on Microwave Theory and Techniques, Vol. 39, No. September 1991, pp. 1462–1467. Generally, superconductor film 10 is formed from materials such as YBaCuO (123), TlBaCaCuO (2212 or 2223), TlPbSrCaCuO (1212 or 1223), or the like.

Superconducting film 10 can be deposited onto substrate 20 by methods known in the art. See, for example, Holstein et al., "Preparation and Characterization of $Tl_2Ba_2CaCu_2O_8$ Films on 100 $LaAlO_3$", IEEE, Trans. Magn., Vol. 27, pp. 1568–1572, 1991 and Laubacher et al., "Processing and Yield of $YBa_2Cu_3O_{7-x}$ Thin Films and Devices Produced with a $BaF_2$ Process", IEEE, Trans. Magn., Vol. 27, pp. 1418–1421, 1991. Generally, the thickness of film 10 is in the range of 0.2 to 1.0 micron, preferably 0.5 to 0.8 micron.

Microwave resonator 100 is formed by positioning substrates 20 bearing superconducting film 10 on dielectric 30. Substrates 20 can be placed on the surface of dielectric 30, or, alternatively, low loss adhesive materials may be employed. Polymethyl methacrylate optionally may be deposited onto the surface of superconducting film 10 to more firmly bond dielectric 30, as well as to protect superconducting film 10.

Dielectric 30 may be provided in a variety of shapes. Preferably, dielectric 30 is in the form of circular cylinders or polygons. Dielectric 30 may be formed of any dielectric material with a dielectric constant $\epsilon_r > 1$. Such dielectric materials include, for example, sapphire, fused quartz, and the like. Generally, these dielectric materials have a loss factor (tan δ) of from $10^{-6}$ to $10^{-9}$ at cryogenic temperatures. The $\epsilon_r$ and tan $\epsilon$ of the dielectric material can be measured by methods known in the art. See, for example, Sucher et al., "Handbook of Microwave Measurements", Polytechnic Press, Third Edition, 1963, Vol. III, Chapter 9, pp. 496–546.

The configuration of the microwave resonator 100, when in use, is maintained by holding device 25 e.g., see FIG. 1(*a*). The holding device can be any embodiment that maintains the relative positions of the components of the resonator during thermal cycling associated with use of the resonator. FIG. 1(*a*) shows a first embodiment of a holding device that employs spring loading. As shown in FIG. 1(*a*), the configuration of microwave resonator 100 is maintained by holding device 25. Holding device 25 includes sidewalls 45, bottom plate 50, top lid 60, pressure plate 70, and load springs 80. Load springs 80 are sufficiently strong to retain the configuration of the microwave resonator during thermal cycling. Load springs 80 preferably are formed of nonmagnetic material in order to prevent disturbing the radio frequency fields in the resonator to achieve the highest possible Q-values. Load springs 80 preferably are formed of Be-Cu alloys.

Parts 45, 50, 60 and 70 of holding device 25 are made of thermally and electrically conductive materials in order to reduce radio frequency loss as well as to enable efficient cooling of resonator 100. Parts 45, 50, 60 and 70 therefore may be formed of, for example, oxygen fired copper, aluminum, silver, preferably oxygen fired copper or aluminum.

The high $T_c$ superconductor-dielectric microwave resonators of the invention are capable of attaining extremely high Q-values, due in part, to the ability of substrate 20 bearing film 10 to prevent axial radio frequency fields from extending beyond the London penetration depth of the superconducting film 10. This is accomplished where substrates 20 are substantially greater than the diameter of dielectric 30 so that radio frequency fields are confined within the cavity region between substrates 20.

The high Q-value superconducting microwave resonators provided by the invention have a variety of potential applications. Typically, these resonators may be employed in applications such as filters, oscillators, as well as radio frequency energy storage devices.

Figure 2:
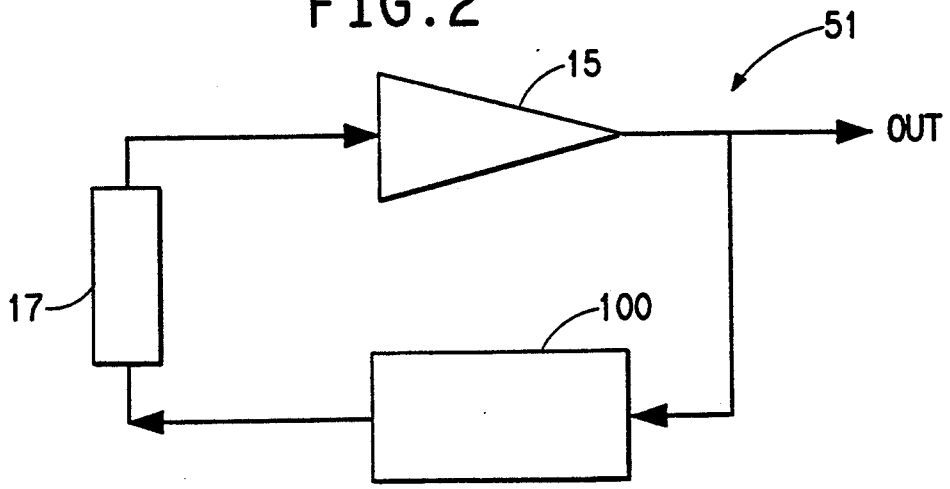
FIG. 2 is a schematic block diagram of a frequency stable element for oscillators that employs the microwave resonator of the invention.

The microwave resonators of the invention also may be employed as frequency stable elements to reduce the phase noise for oscillators. As shown in FIG. 2, circuit 51 employs a microwave resonator 100 of the invention that is inserted into a closed feedback loop of, preferably, a low noise amplifier 15. Where the product of the gain of amplifier 15 and the insertion loss of resonator 100 is greater than one, and where the total phase of the closed loop, as adjusted by phase shifter 17, is a multiple of $2\pi$, then, due to the extremely high Q-values of the superconducting microwave resonators of the invention, the oscillator can be made to oscillate at the microwave resonator's resonant frequency to yield-lower phase noise in the oscillator. The term "out" indicates a line out of the loop.

The superconducting microwave resonators of the invention also may be employed to provide highly stable frequencies suitable for secondary standards for frequency or time. Since the microwave resonator has an extremely high Q-value and operates at a constant cryogenic temperature, the microwave resonator has a very stable resonate frequency that makes the resonator useful for serving as a secondary standard.

Figure 3A:
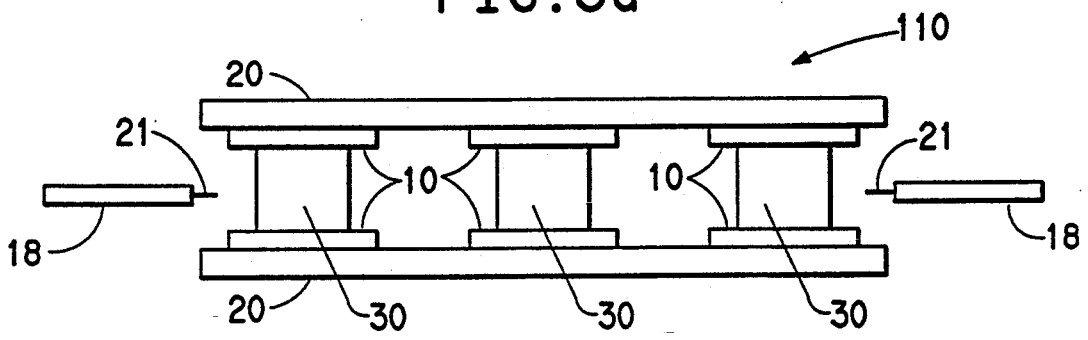
FIGS. 3(*a*) and 3(*b*) show configurations of filters using superconducting microwave resonators according to the invention.
Figure 3B:
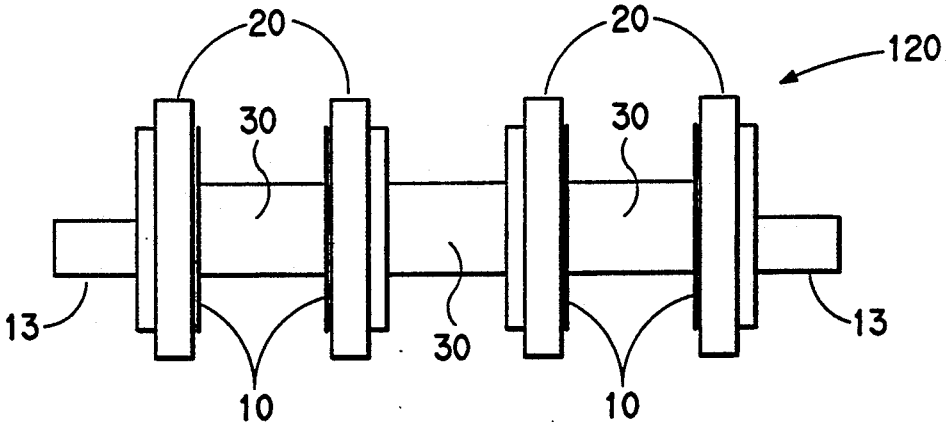

The superconducting microwave resonators of the invention further may be employed as building blocks in passive devices such as filters. Examples of such filters are shown in FIGS. 3(*a*) and 3(*b*). As illustrated in FIG. 3(*a*), filter 110 shown in the form of a series of dielectrics 30 sandwiched between substrates 20 bearing superconducting films 10. Coupling between dielectrics 30 is achieved by the evanescent fields of dielectrics 30.

Coupling of filter 10 to electronic circuits (not shown) can be achieved by coaxial cable 18 bearing coupling loop 21.

FIG. 3(*b*) shows an alternative embodiment of a filter. As shown in FIG. 3(*b*), filter 120 employs a series of dielectrics 30. Coupling between dielectrics 30 is achieved by the evanescent fields of dielectrics 30 via openings (not shown) on substrates 20. Coupling of filter 120 to an electronic circuit (not shown) can be achieved by couplings 13. Couplings 13 can be coaxial lines, waveguides, or other transmission lines. In either of the embodiments of FIGS. 3(*a*) or 3(*b*), the high Q-values of the superconducting microwave resonators reduces the in-band insertion loss of the filter so as to make the skirt of the frequency response curve of the filter steeper.

An additional application of the superconducting, microwave resonators of the invention is to measure the surface impedance ($Z_s$) of superconductor materials and the complex dielectric constant $\epsilon_r=\epsilon_r'-j\epsilon_r''$ of dielectric materials, where $Z_s$ and $\epsilon_r$ have been determined by measurement of $f_0$ and Q at two differing modes in accordance with methods known in the art. The surface impedance ($Z_s$) is defined as the ratio of the voltage to the current. The complex dielectric constant $\epsilon_r=\epsilon_r'-j\epsilon_r''$ is defined as the ratio of the electrical displacement vector (D) and the electric field strength vector (E). $E_r'$ is a measure of the capability of electrical energy storage of the dielectric material. $E_r''$ is a measure of the electrical loss in the dielectric material. The symbol j is the unit of an imaginary number.

Generally, high Q-values for the superconducting microwave resonators of the invention may be obtained by selecting the proper electromagnetic modes to prevent flow of radio frequency current across the edges of superconducting films 10. These proper modes are $TE_{oin}$ modes where the radial mode index has a value of $i=1,2,3, \ldots$ and the axial mode index has a value of $n=1,2,3, \ldots$ All $TE_{oin}$ modes have only circular radio frequency currents that do not cross the edge of films 10.

Having selected the specific electromagnetic mode of the microwave resonator, the Q and the resonant frequency $f_0$ for the microwave resonator can be calculated by solving Maxwell's Equations for the boundary conditions of the resonator, as is known in the art.

The loss power associated with parasitic coupling to low Q-value modes such as non-$TE_{Oin}$ modes or "case modes" may be minimized in the microwave resonators of the invention by assuring that substrates 20 are flat and parallel to within a tolerance of less than 1°. Loss power also may be minimized by ensuring that the C-axis of anisotropic materials such as sapphire, when employed as dielectric 30, is perpendicular to substrate 20 to within ±5° preferably 1°.

As also is shown in FIG. 1(*a*), microwave resonator 100 can be coupled to an electric circuit (not shown) by coaxial cable 18 that includes coupling loop 21 protruding into cavity 90 of microwave resonator 100. The orientation of coupling loop 21 and the depth of insertion of coaxial cable 18 into cavity 90 readily can be adjusted to ensure coupling to the electronic circuit.

In a preferred aspect of the invention, superconducting film is formed by epitaxially depositing 0.5 micron superconducting films of $Tl_2Ba_2Ca_1Cu_2O$ or $YBa_2Cu_3O$ on 2 inch diameter substrates of $LaAlO_3$ positioned on cylindrical dielectrics of sapphire. The superconducting film is deposited so that the C-axis of the film is perpendicular to the surface of the substrate. The dielectrics of sapphire typically measure 0.625 inch diameter by 0.276 inch tall, 0.625 inch diameter by 0.552 inch tall, or 1.00 inch diameter by 0.472 inch tall. The substrates and dielectric are retained in position by a holding device formed of oxygen free copper. Coupling of the microwave resonator to an electrical circuit can be achieved by inserting two 0.087 inch diameter copper or stainless steel, 50 ohm coaxial cables with coupling loops made of extended inner conductor into the cavity of the resonator. The surface of the coupling loops is perpendicular to the vertical axis of the sapphire dielectric to enable selective coupling to the $TE_{011}$ (i=1, n=1) mode of the dielectric.

Figure 4:
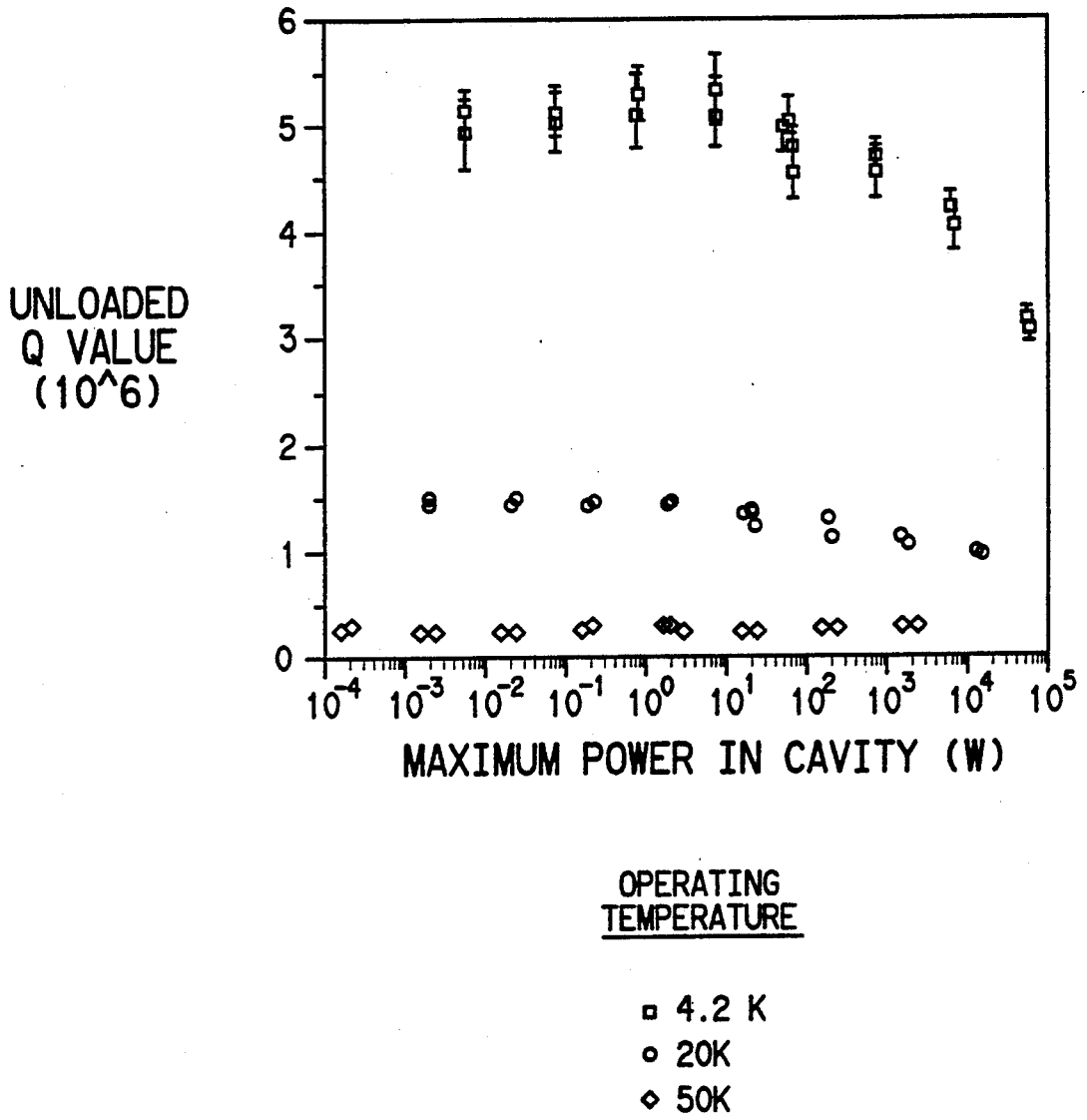
FIG. 4 shows the Q-values of a superconducting microwave resonator of the invention that employ $YBa_2Cu_3O$ superconductor and sapphire dielectric.
Figure 5:
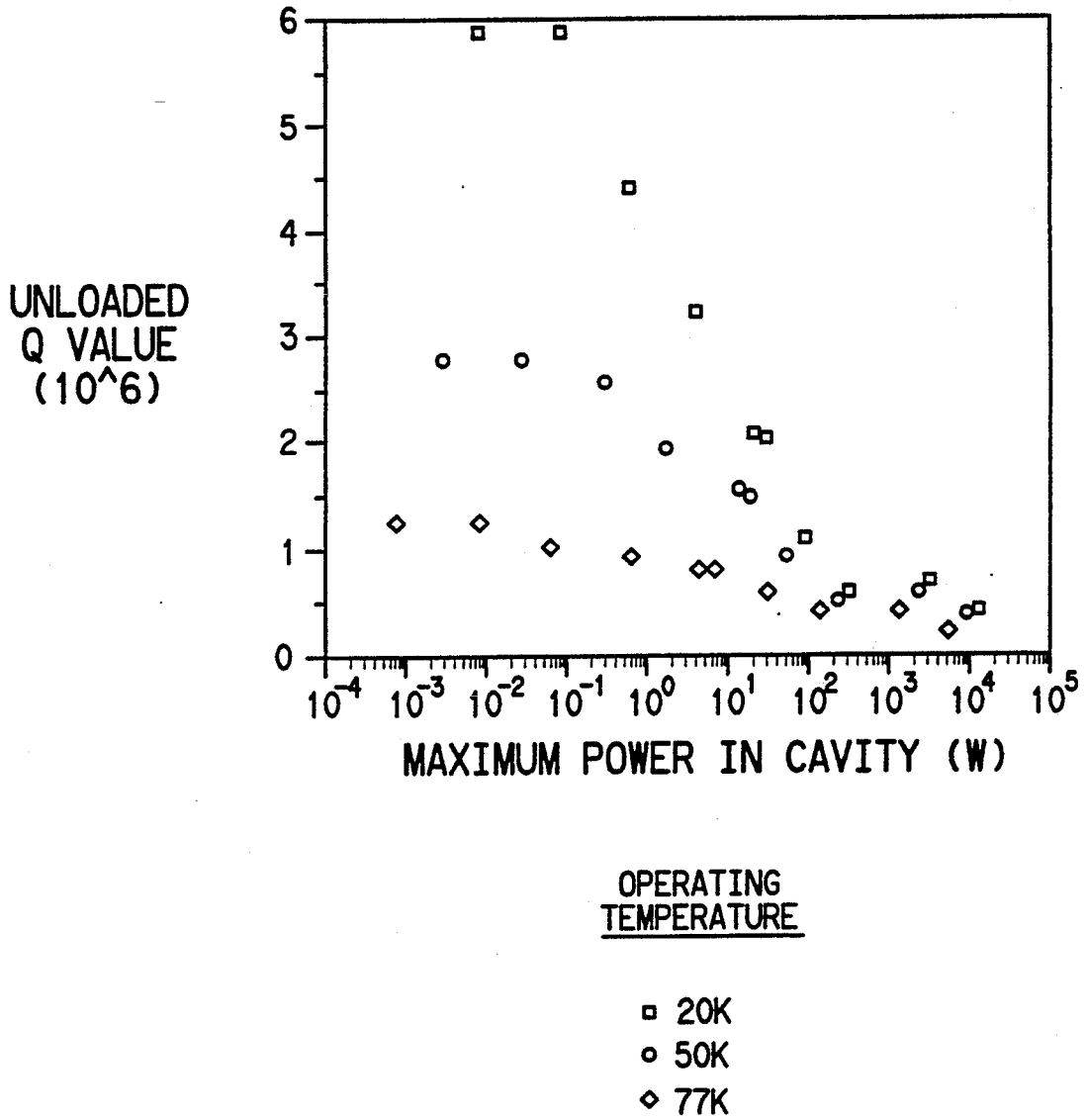
FIG. 5 shows the Q-values of a superconducting microwave resonator of the invention that employs TlBaCaCuO superconductor and sapphire dielectric.

The Q values of the above described microwave resonators, when employing $YBa_2Cu_3O$ as the superconducting film, are shown in FIG. 4. As shown in FIG. 4, Q values of 5 million, 1.5 million, and 0.25 million are found at temperatures of 4.2K, 20K and 50K, respectively. The Q values of the above described microwave resonators, when employing $Tl_2Ba_2Ca_1Cu_2O$ as the superconducting film, are shown in FIG. 5. As shown in FIG. 5, Q values of 6 million, 3 million, and 1.3 million are found at temperatures of 20K, 50K, and 77K, respectively.

Figure 6:
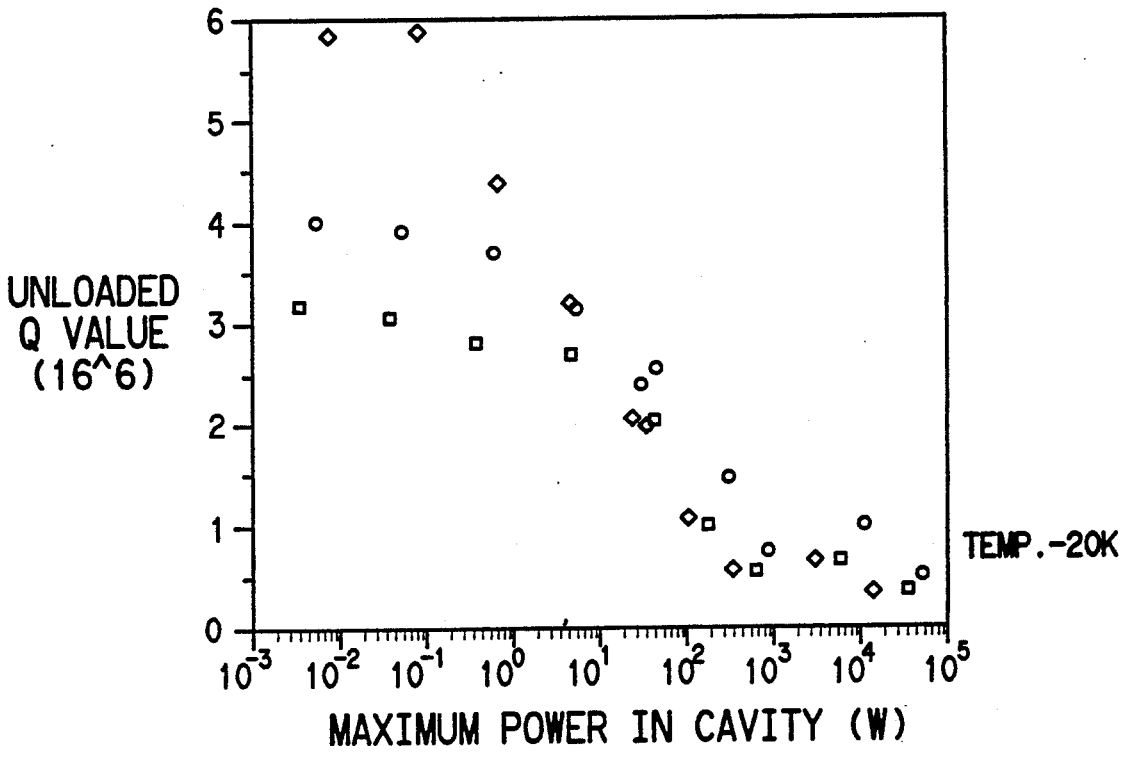
FIG. 6 shows the relationship of Q-value of the resonator to the size of the dielectric.

The dependence of Q values of the above described microwave resonators that employ $Tl_2Ba_2Ca_1Cu_2O$ as the superconducting film on the size of the sapphire dielectric is shown in FIG. 6. As shown in FIG. 6, the Q values increase from 3 million to 6 million with increasing size of the sapphire dielectric.

Device 25 shown in FIG. 1(*a*) that employs spring loading is only illustrative. Other means for holding microwave resonator 100 are shown below.

Figure 7A:
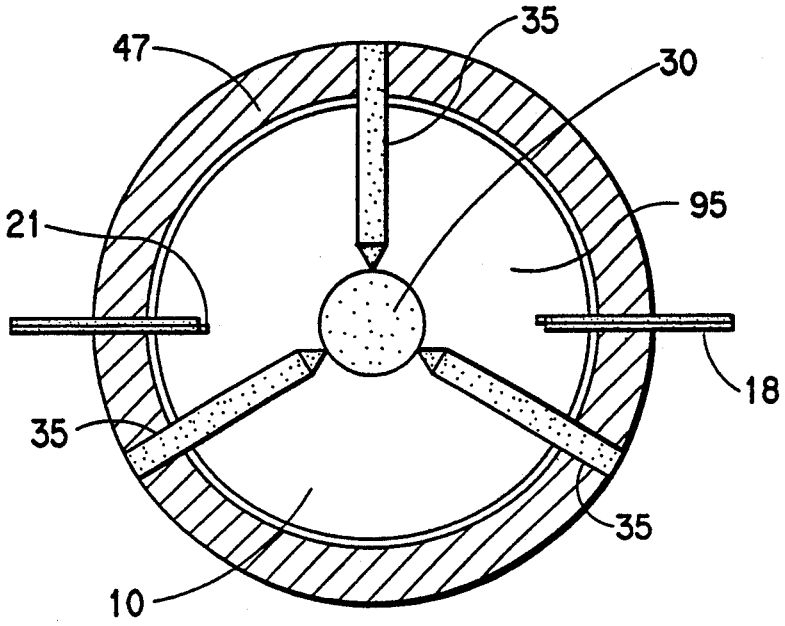
FIG. 7(*a*) shows the horizontal cross sectional view of an alternative embodiment of a device for holding the microwave resonators of the invention.
Figure 7B:
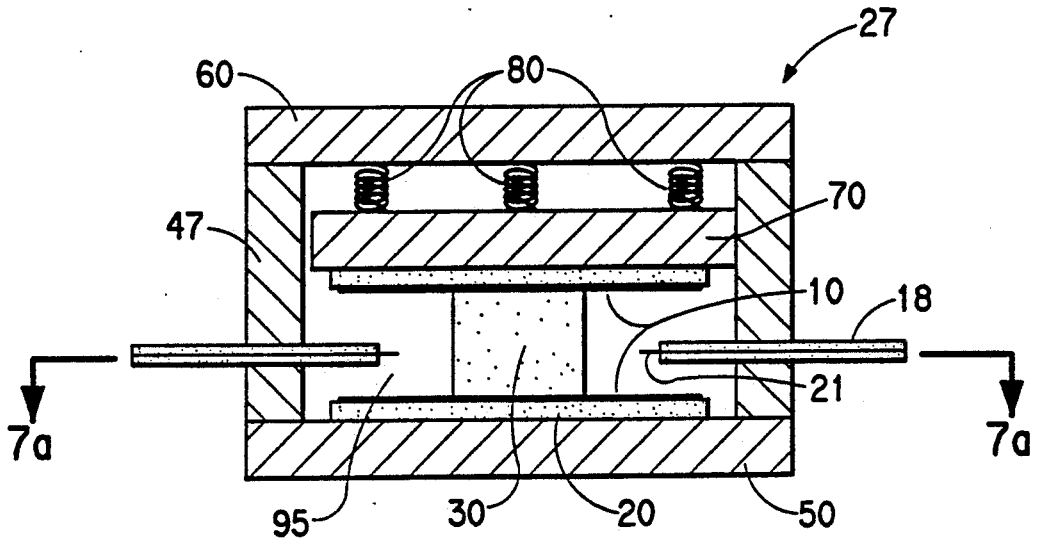

FIGS. 7(*a*) and 7(*b*) show an alternative embodiment for holding the microwave resonators of the invention. As shown in FIG. 7, the microwave resonator is held by holding device 27. Device 27 is indentical to device 25 except that, as shown in FIG. 7(*a*), spring loaded holding device 27 employs three dielectric rods 35 positioned 120° relative to each other to further support dielectric 30. Dielectric rods 35 are inserted through side walls 47 of holding device 27 into cavity 95. Dielectric rods 35 have a low loss and a dielectric constant less than that of dielectric 30. The tips of rods 35 are pointed to minimize contact area with dielectric 30 to minimize loss power. Superconducting film 10 is in contact with dielectric element 30. Coupling of the resonator to electronic circuits (not shown) is achieved by coaxial cable 18 bearing coupling loop 21.

Figure 8:
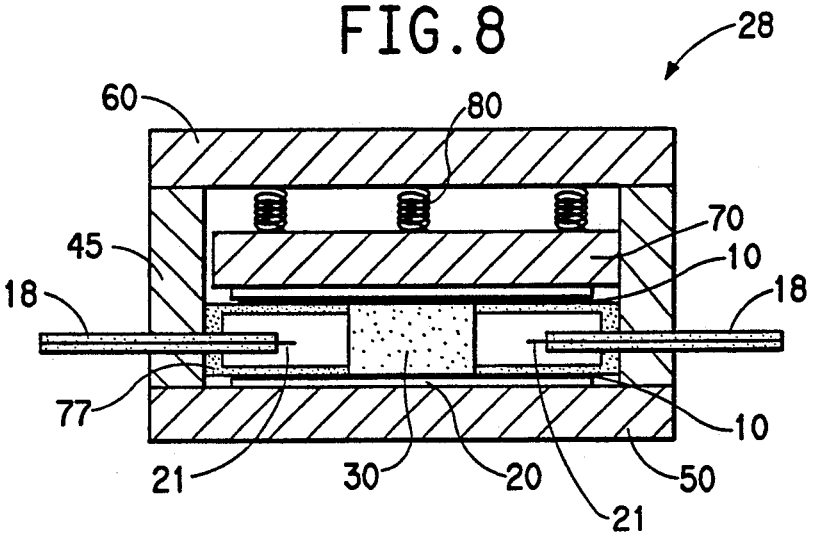
FIG. 8 shows a vertical cross section of a further embodiment of a device for holding the microwave resonator of the invention.

A further embodiment of a device for holding the microwave resonators of the invention is shown in FIG. 8. As set forth in FIG. 8, the microwave resonator is retained in position by holding device 28. Holding device 28 includes sidewalls 45, bottom plate 50, top lid 60, pressure plate 70, and load springs 80, and is identical to holding device 25 except for the additional use of retainer 77. As shown in FIG. 8, substrate 20 bearing superconducting film 10 is positioned on bottom-plate 50. Dielectric 30 is positioned on substrate 20. Retainer 77 is positioned about dielectric 30. Retainer 77 contacts sidewalls 45 and superconducting film 10 on substrate 20. Retainer 77 and side walls 45 have openings for receiving coaxial cables 18. Cables 18 have loops 21 for coupling of the resonator to an electric circuit(not shown). Retainer 77 is formed of materials that have low dielectric constant of nearly 1 and low tan δ of $<10^{-4}$. As shown in FIG. 8, retainer 77 is hollow, and is solid neat sidewalls 45 where the electrical fields are minimum. The wall thickness of retainer 77 is minimized to reduce the contact area between retainer 77 and dielectric 30 to minimize loss power.

Figure 9:
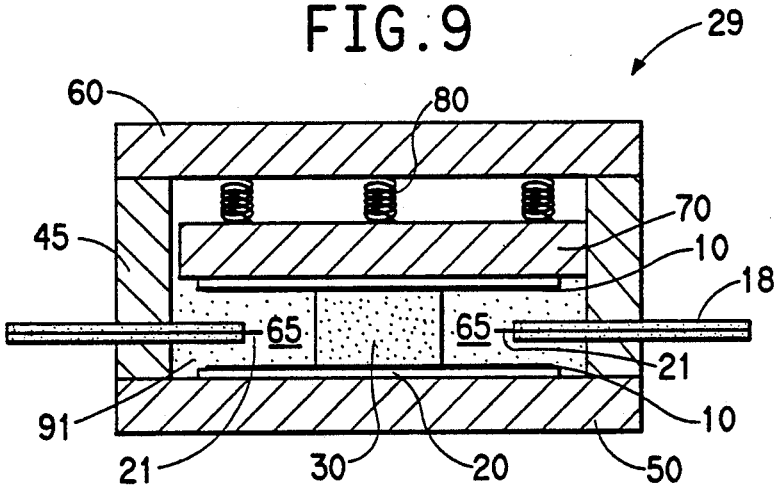
FIG. 9 shows a vertical cross section of a further alternative embodiment of a holding device for the microwave resonators of the invention.

Still yet another embodiment of a holder device for the microwave resonators of the invention is shown in FIG. 9. Holding device 29 shown in FIG. 9 is identical to holding device 25 except for the use of additional dielectric 65. As shown in FIG. 9, cavity 91 between dielectric 30 and the interior surface of sidewall 45 of device 29 is filled with dielectric material 65. Dielectric material 65 has a tan $\delta$ of less than $10^{-5}$. Examples of dielectric material 65 include styrofoam, porotic TEFLON®, and the like.

Figure 10:
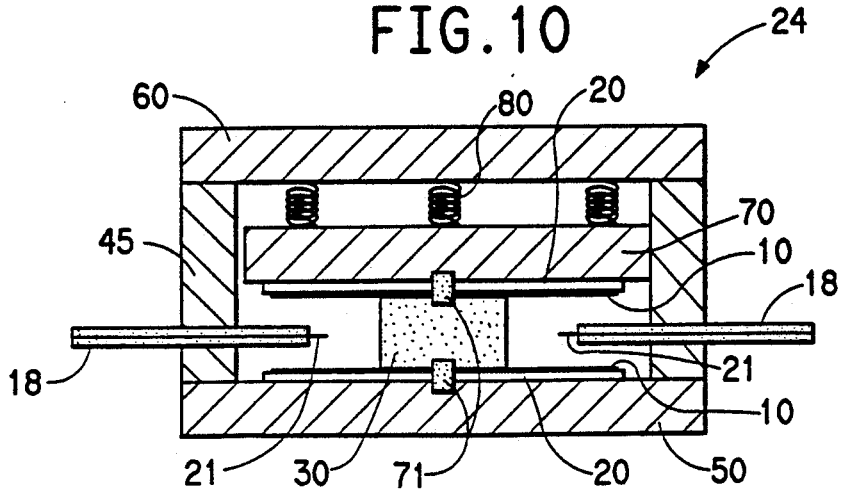
FIG. 10 shows a vertical cross section of a further embodiment of a holding device for the microwave resonators of the invention.
Figure 11A:
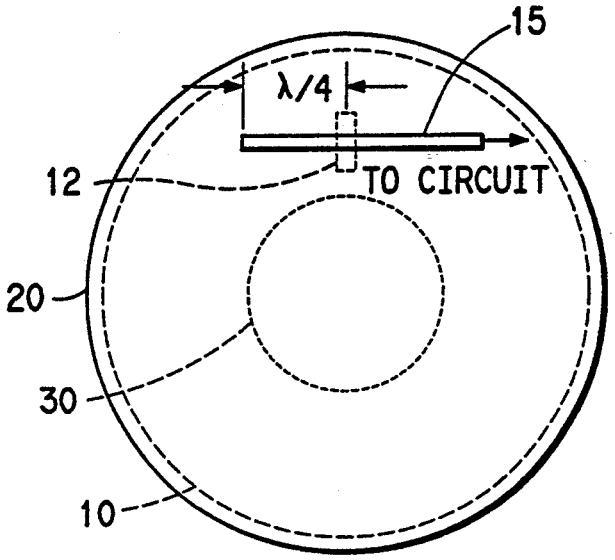
FIGS. 11((*a*)–11(*d*) show top views of alternative embodiments for coupling the microwave resonators of the invention to an electronic circuit.
Figure 11B:
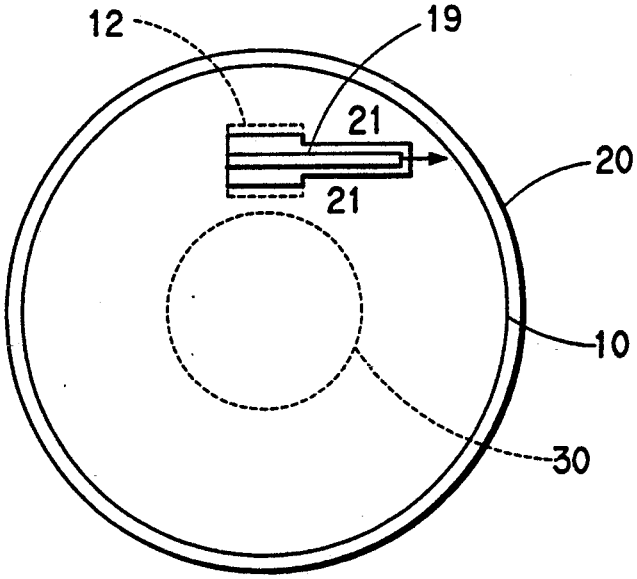
Figure 11C:
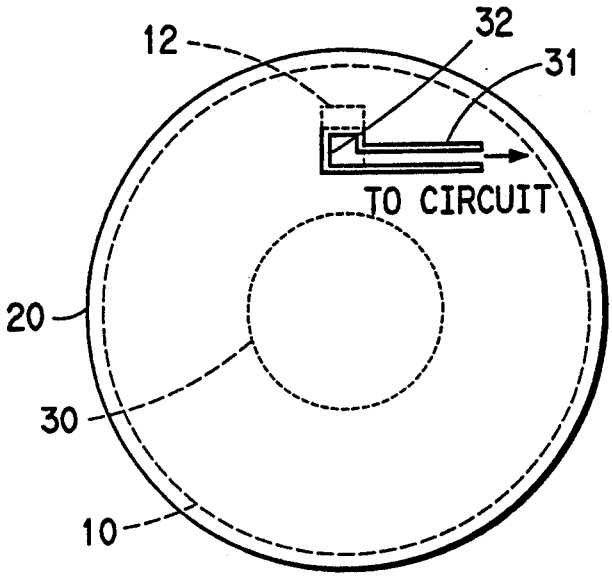
Figure 11D:
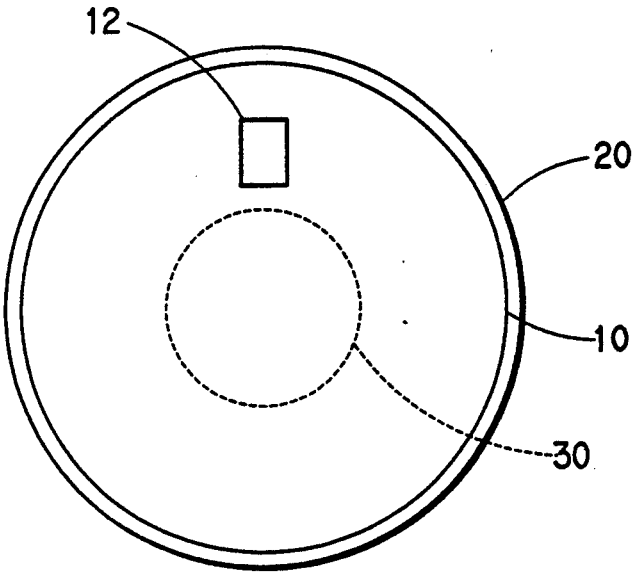

FIG. 10 shows a further embodiment of a holding device suitable for use with the superconducting microwave resonators of the invention. Holding device 24 shown in FIG. 10 is identical to holding device 25 except for additional use of holding pins 71. As shown in FIG. 10, pins 71, formed of low tan $\delta$ dielectric materials such as sapphire, quartz, polymers, polytetrafluoroethylene TEFLON®, DELRIN®, registered trademarks of E. I. du Pont de Nemours and Company, and the like are inserted into substrate 20 bearing superconducting film 10 and into dielectric 30.

FIGS. 11(*a*) to 11(*d*) show alternative embodiments for coupling of the microwave resonators of the invention to an electronic circuit (not shown). Generally, the embodiments shown in FIGS. 11(*a*)–11(*c*) entail use of substrates that bear superconducting films on the surfaces of the substrate that directly contacts dielectric 30. Openings are provided on the superconducting film on the side which directly contacts dielectric 30. A coupling device is located over the opening on surface of the substrate that does not contact dielectric 30.

FIG. 11(*a*) shows a microstrip line coupling mechanism for coupling of the microwave resonators of the invention to an electronic circuit (not shown). In FIG. 11(*a*), microstrip line 15 is formed by depositing superconducting film material on that surface of substrate 20 that is remote to dielectric 30. Microstrip line 15 serves as the lead to an electronic circuit (not shown). Opening 12 is provided in film 10 on the surface of substrate 20 that contacts dielectric 30. Opening 12 extends through film 10 but not through substrate 20. Opening 12 does not contact dielectric 30 in order to minimize the effects of magnetic fields on dielectric 30. Opening 12 is parallel to the local magnetic field. Coupling is achieved by magnetic field leakage through opening 12 to line 15. Microstrip line 15 extends over opening 12 by a distance of $\lambda/4$, where $\lambda$ is the wavelength of the radio frequency field at the operating frequency of the resonator.

FIG. 11(*b*) shows a coplanar line coupling mechanism for coupling the microwave resonators of the invention to an electronic circuit (not shown). The coplanar line coupling is formed by depositing superconducting film material on that surface of substrate 20 that is remote to dielectric material 30 to form center line 19 and ground plane 21. The coplanar line coupling serves as the lead to an electronic circuit (not shown). The coplanar line coupling extends over opening 12. Opening 12 is provided by film 10 on the surface of substrate 20 that contacts dielectric material 30. Opening 12 extends through film 10 but not through substrate 20. Opening 12 does not contact dielectric material 30.

In the coplanar line coupling of FIG. 11(*b*), center line 19 is short circuited to ground plane 21. Center line 19 extends across opening 12. Opening 12 is parallel to the local magnetic field. Coupling is achieved by magnetic field leakage through slot 12 to center line 19.

FIG. 11(*c*) shows a parallel line coupling mechanism for coupling dielectric material 30 to an electronic circuit(not shown). The parallel line coupling includes parallel lines 31 and loop 32. The parallel line coupling is formed by depositing superconducting film material on that surface of substrate 20 that is remote to dielectric material 30. The parallel line coupling mechanism serves as the lead to an electronic circuit (not shown). Parallel lines 31 and loop 32 extend over opening 12. Opening 12 is provided in film 10 on the surface of substrate 20 that contacts dielectric material 30. Opening 12 extends through film 10 but not through substract 20. Opening 12 does not contact dielectric material 30. Coupling is achieved by leakage of magnetic field through opening 12 which is captured by loop 32.

FIG. 11(*d*) shows a coupling mechanism useful for microwave resonators such as those used for a filter as shown in FIG. 3(*b*). As shown in FIG. 11(*d*), the coupling mechanism employs identical, congruent slot 12 through film 10 of both surfaces of substrate 20. Slots 12 extend through films 10 but terminate at the surfaces of substrate 20. Slots 12 on each surface of substrate 20 may be the same or different in size. Coupling is achieved by leakage of evanescent magnetic field through slots 12.

Figure 12:
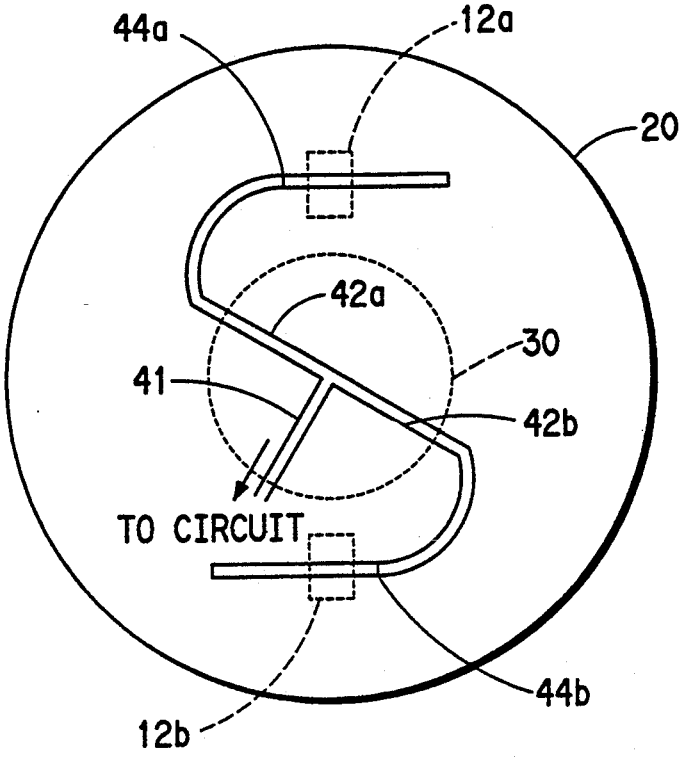
FIG. 12 shows a top view of a coupling mechanism that utilizes dual couplings for coupling the microwave resonators of the invention to an electronic circuit.

Coupling of the microwave resonator also may be achieved through dual couplings. FIG. 12 shows a dual coupling mechanism that utilizes dual identical coupling microstrip lines 44(*a*) and 44(*b*) that cross slots 12(*a*) and 12(*b*) on film 10 (not shown). Slots 12(*a*) and 12 (*b*) are provided in film 10 on that surface of the substrate 20 that contacts dielectric 30. Slots 12(*a*) and 12(*b*) terminate at the surface of substrate 20. Couplings 44(*a*) and 44(*b*) are connected by lead line 41 that is divided into equal length branches 42(*a*) and 42(*b*). Lines 44(*a*) and 44(*b*) and lead line 41 are formed by depositing superconductive material onto substrate 20. Coupling is achieved by leakage of evanescent magnetic field through slots 12(*a*) and 12(*b*). The dual coupling mechanism shown in FIG. 12 enables selective coupling to the $TE_{011}$ mode and suppresses competing electromagnetic field modes that have antisymmetrical magnetic field distribution. "To circuit" indicates that lead line 41 leads to an electrical circuit.

Figure 13:
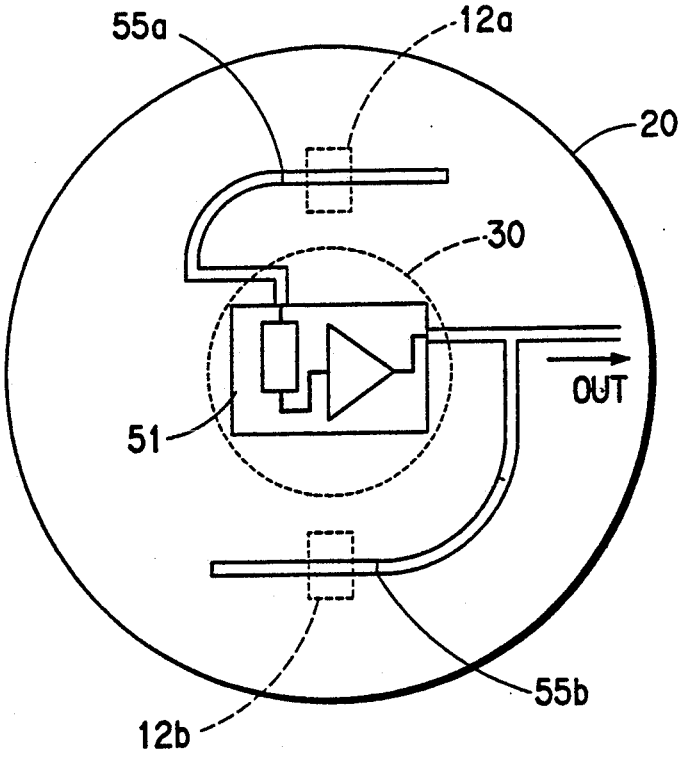
FIG. 13 shows a top view of a coupling of the microwave resonator of the invention to an electronic circuit integrated onto the back side of the substrate.

The coupling mechanisms of the invention also provide for ease of connection to circuits integrated onto substrate 20. As shown in FIG. 13, a circuit is integrated onto the side of substrate 20 that bears coupling mechanisms 55(*a*) and 55(*b*). Couplings 55(*a*) and 55(*b*) may be formed by depositing superconductive film material onto substrate 20 over slots 12(*a*) and 12(*b*). Slots 12(*a*) and 12(*b*) are provided in the superconducting film (not shown) on that side of substrate 20 that contacts dielectric 30. Slots 12(*a*) and 12(*b*) extend through the superconductor film but terminate at the surface of substrate 20. Coupling is achieved by leakage of magnetic field through slots 12(*a*) and 12(*b*).

Integration of circuits onto substrate 20 as shown in FIG. 13 may be achieved by well known thin film printed circuit technology. If the circuit is a hybrid circuit that employs, for example, transistors, then the transistors can be integrated into the circuit by conventional wire bonding. The term "OUT" indicates a line out of the loop.

Figure 14:
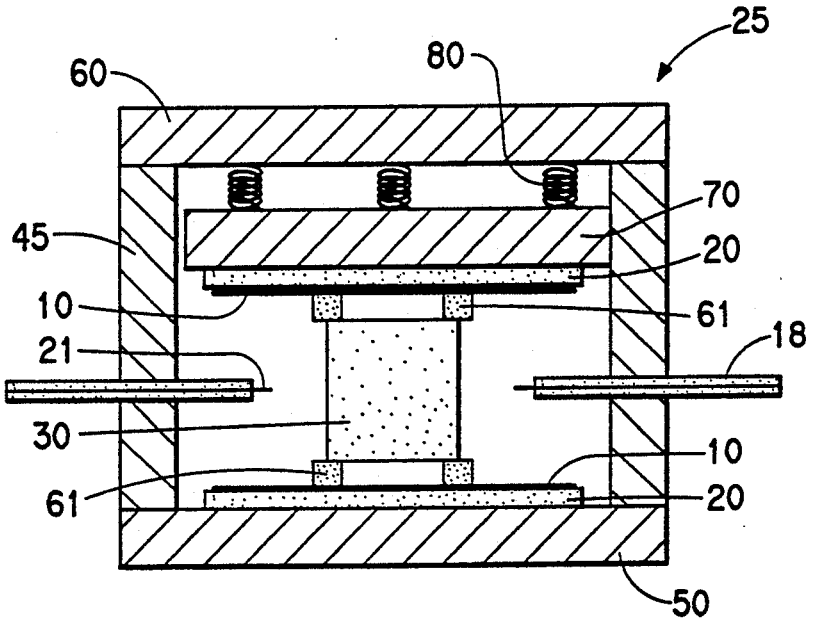
FIG. 14 shows a vertical cross section of an alternative embodiment of the microwave resonators of the invention.

FIG. 14 shows an alternative embodiment of the superconducting microwave resonator of the invention that is retained by holding device 25. As shown in FIG. 14, rings 61 with a dielectric constant much less than that of dielectric 30 are inserted between dielectric 30 and superconducting film 10. Rings 61, by placing dielectric 30 further from superconducting film 10, enable the microwave resonator to handle greater power levels.

From the foregoing description, one skilled in the art can easily ascertain the essential characteristics of this invention, and without departing from the spirit and scope thereof, can make various changes and modifications of the invention to adapt it to various uses and conditions.

What is claimed is:

1. A high temperature superconducting microwave resonator operated in a $TE_{0in}$ mode, wherein i and n are integers of at least 1 comprising a dielectric element and a plurality of substrates each bearing a coating of high temperature superconducting material, said dielectric element and substrates enclosed by a top lid, sidewalls, and a bottom plate, wherein said substrates are positioned relative to said dielectric element to enable said coating to contact said dielectric element and wherein said substrates do not contact the sidewalls.

2. The high temperature superconducting microwave resonator of claim 1 wherein said dielectric element is selected from the group consisting of sapphire and quartz.

3. The high temperature superconducting microwave resonator of claim 2 wherein said dielectric element is sapphire.

4. The high temperature superconducting microwave resonator of claim 1 wherein said substrates are single crystals that are lattice matched to said superconducting material.

5. The high temperature superconducting microwave resonator of claim 4 wherein said substrates are selected from the group consisting of $LaAlO_3$, $NdGaO_3$ and MgO.

6. The high temperature superconducting microwave resonator of claim 1 wherein said superconducting material has a surface resistance at least ten times less than a surface resistance associated with copper.

7. The high temperature superconducting microwave resonator of claim 6 wherein said superconducting material is selected from the group consisting of YBaCuO(123), TlBaCaCuO(2212), TlBaCaCuO(2223), TlPbSrCaCuO(1212) or TlPbSrCaCuO(1223).

8. The high temperature superconducting microwave resonator of claim 1 further comprising dielectric rings positioned between said dielectric element and said substrates adjacent to said dielectric element.

9. The high temperature superconducting microwave resonator of claim 1 additionally comprising a means for coupling the resonator to an electrical circuit, said means for coupling comprising 1) at least one opening in at least one coating on one side of at least one of the substrates, and opposite side of said substrate being in contact with the dielectric element, for passing electromagnetic fields generated by the dielectric element through at least one of the substrates and 2) a coupling line at said opening and connected to an electrical circuit to transfer the electromagnetic fields generated by the dielectric element through at least one of the substrates to an electrical circuit.

10. The high temperature superconducting microwave resonator of claim 9 wherein said coupling line is a microstrip line.

11. The high temperature superconducting microwave resonator of claim 9 wherein said coupling line is a coplanar line.

12. The high temperature superconducting microwave resonator of claim 9 wherein said coupling line is a parallel line connected by a coupling loop.

13. The high temperature superconducting microwave resonator of claim 9 wherein the coupling line comprises a high temperature superconductor.

14. A device for retaining the configuration of a superconducting microwave resonator, said microwave resonator operated in a $TE_{0in}$ mode, wherein i and n are integers of at least 1, comprising a dielectric element and a plurality of substrates each bearing a coating of high temperature superconducting material, said dielectric element and substrates enclosed by a top lid, sidewalls, and a bottom plate, wherein said substrates are positioned in alignment with said dielectric element and oriented to enable said coating to contact said dielectric element and wherein the substrates do not contact the sidewalls, said device comprising means to position the substrates in alignment with said dielectric element during use of said microwave resonator in an electrical circuit.

15. The device of claim 14 wherein said device further comprises a retainer positioned between said substrates and contacting said dielectric element.

16. The device of claim 14 further comprising a coupling means in contact with said coating on at least one of said substrates for transferring electromagnetic energy between said dielectric element through said substrates to an electrical circuit.

17. The device of claim 16 wherein said coupling means comprises a coaxial cable with coupling loops comprised of an extended inner conductor of said cable, said cable positioned between said substrates of said microwave resonator.

18. The device of claim 14 wherein said device includes a second dielectric material composition contained within a cavity defined by said dielectric element, said substrates in contact with such element, and said sidewalls, wherein the composition of said second dielectric material is distinct from the composition of said dielectric element of said microwave resonator.

19. The device of claim 14 wherein said device is comprised of conductive materials selected from the group consisting of copper, aluminum, silver.

20. The device of claim 14 wherein said means is springs comprised of non magnetic material, said springs simultaneously in contact with said substrate and said top lid.

21. The device of claim 20 wherein a plurality of spaced rods of dielectric material contact said dielectric element of said microwave resonator, wherein the composition of said dielectric material of said rods is distinct from the composition of said dielectric of said microwave resonator.

22. A microwave filter operated in a $TE_{0in}$ mode, wherein i and n are integers of at least 1, comprising 1) a plurality of substrates each bearing a coating of high temperature superconducting material, and a plurality of resonant dielectric elements each of which is positioned between said substrates and in contact with said coating and 2) a coupling means connected to at least one of said resonant dielectric elements and to an electronic circuit.

23. The filter of claim 22 wherein said resonant dielectric elements and substrates each bearing a coating of high temperature superconducting material are in alternating positions relative to each other which enable said coating to contact said dielectric element.

* * * * *